US006822544B2

(12) United States Patent
Shiga et al.

(10) Patent No.: US 6,822,544 B2
(45) Date of Patent: Nov. 23, 2004

(54) MAGNET SWITCH FOR STARTER

(75) Inventors: Tsutomu Shiga, Nukata-gun (JP); Masami Niimi, Handa (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/403,022

(22) Filed: Apr. 1, 2003

(65) Prior Publication Data

US 2003/0189472 A1 Oct. 9, 2003

(30) Foreign Application Priority Data

Apr. 3, 2002 (JP) ..... 2002-101434

(51) Int. Cl.[7] ..... H01H 67/02
(52) U.S. Cl. ..... 335/126; 335/131
(58) Field of Search ..... 335/126, 131; 290/48; 200/292

(56) References Cited

U.S. PATENT DOCUMENTS 5,525,947 A 6/1996 Shiga et al.
5,610,445 A * 3/1997 Shiga et al. ..... 290/38 R
5,777,393 A * 7/1998 Katoh et al. ..... 290/48
6,054,777 A 4/2000 Soh
6,114,772 A * 9/2000 Araki et al. ..... 290/48
6,448,518 B1 * 9/2002 Martin et al. ..... 200/292

FOREIGN PATENT DOCUMENTS

WO WO 01/80377 A1 10/2001

* cited by examiner

*Primary Examiner*—Lincoln Donovan
(74) *Attorney, Agent, or Firm*—Oliff & Berridge, PLC

(57) ABSTRACT

In a magnet switch for a starter, a first contact portion and a second contact portion are connected in parallel between a battery and a motor. The first contact portion makes contact through a resistive component so that the motor starts rotation at low speed. By this, a pinion is pushed in an axial direction by an axial component of splines and brought into mesh with a ring gear in a condition that its rotation is restricted. Thereafter, the second contact portion makes contact in accordance with further movement of a plunger so that electric power is fully supplied to the motor through the second contact portion, thereby starting engine. A fixed contact of the first contact portion is made of a carbon material. The resistive component is provided by the carbon material.

21 Claims, 4 Drawing Sheets

MAGNET SWITCH FOR STARTER

CROSS REFERENCE TO RELATED APPLICATION

This application is based on Japanese Patent Application No. 2002-101434 filed on Apr. 3, 2002, the disclosure of which is incorporated herein by reference.

FIELD OF THE INVENTION

The present invention relates to a starter used to start an internal combustion engine. More specifically, the present invention relates to a magnet switch for the starter.

BACKGROUND OF THE INVENTION

There are various efforts to cope with recent environmental issues in a field of automobiles. With this, a vehicle starter has required various improvements, such as compactness, light weighting and long wearing against an engine idle stop (for eco-run). To meet this requirement, a starter disclosed in JP-A-9-68142 (U.S. Pat. No. 5,525,947) reduces damage to a ring gear by improving meshing of a pinion. Further, the starter is capable of a fine electronic control by reducing a switch electric current. That is, an electric power is supplied to a sub contact through a resistor so that a motor starts rotation at a low speed and the pinion is brought into mesh with the ring gear with that rotation force. Thereafter, the electric power is supplied to a main contact so that the motor rotates at full speed. Therefore, only an attraction force to close the contact for the motor is required. Accordingly, the switch electric current is reduced more than seventy percents as compared with the case that the pinion is meshed by the force of the switch. Thus, it makes possible to turn on and off the switch electric current by using semiconductor, reduce the size.

In the above-described starter, damage to the ring gear is reduced. Also, wear of the main contact is reduced by the virtue of the sub contact. However, problems arise from the sub contact.

For example, in a point of a durability of the sub contact, because the sub contact is made of metal and is on and off an electric current of about 100 A, it is easily worn due to arc heat. In another aspect, because a resistor is required, durability of the resistor becomes a problem. For example, if a key switch of the vehicle is locked at a starter position, the electric current may be continuously supplied to a coil. As a result, the components, such as the resistor and a coil, are burned and the sub contact cannot perform properly.

In further another aspect, chattering of the sub contact or an increase in a minimum operation voltage becomes problem. FIG. 6 is a graph showing relationship between a force F and a stroke D of the switch. In FIG. 6, a force F1 that is required to operate the switch and an attraction force F2 generated by the switch are plotted. The force F1 is determined by converting loads of a return spring, a contact pressure spring and the like driven by the switch to the force of the plunger.

When the plunger is moved, the sub contact is closed at a point Da. When the motor current is supplied through the sub contact, the voltage drops, thereby reducing the switch current. In a case that a power supply voltage is high enough, the switch continuously attracts the plunger. However, in a case that the power supply voltage is low, the attraction force F2 reduces lower than the force F1, as denoted by dotted line in FIG. 6. Therefore, the plunger is returned back with the spring force, thereby opening the sub contact. As a result, the sub contact chatters at the point Da. At the worst, the contact may be excessively heated and stuck together. The above mentioned minimum operation voltage is the minimum voltage required to avoid chattering.

As it may be understood from the above description, the sub contact causes a rapid voltage drop in a middle of the stroke of the plunger. Therefore, the minimum operation voltage of the switch having the sub contact is higher than that of a switch without having the sub contact. When the main contact is closed, the voltage drop is caused. However, when the main contact is closed, the attraction force of the switch is high enough because the plunger has been moved enough. Therefore, it does not cause the problem to the main contact. To solve the problems to the sub contact, the switch, contact and resistor may be enlarged. However, it opposes compactness.

As a means to solve the wear and sticking of the contact, brushes are used as the contact for the motor in publication JP-A-9-310666 (U.S. Pat. No. 6,054,777). However, since the brushes are wearing parts, a predetermined length is required as for a wearing margin. In the starter, the brushes generally have the wearing margin about 10 mm.

Further, the brush generally requires 10 N to 20 N as a set force. In general, two brushes are provided. Therefore, 20 N to 40N are required in total. To provide this force by a spring, it is required to bend the spring about 10 mm to 20 mm (at least about 10 mm). In the case that the brushes are used as the contact, to cope with the change in the length about 10 mm to 20 mm due to wearing of brushes and the setting force, more than 20 mm is required as a stroke of the switch and more than 20 N is required as the attraction force to move the brushes with the plunger.

Actually, it is difficult to meet both the requirements with the switch of the general starter because of its size. There is a trial to increase the stroke and the attraction force by using a principle of a lever (for example, disclosed in DE10018467 A1). However, it is difficult because a working load of the stroke by the attraction force, which cannot meet as the switch, cannot satisfy the working load even if the ratio is changed by the principle of lever. Further, an additional, special, large brush moving means is required.

That is, in the case that the brushes are used as the contact, a large-scale mechanism, such as a large switch, is required. However, this opposes the purpose to reduce the size. Also, the brushes of the starter are generally made of graphite including 50 percents or more copper to reduce contact resistances. Therefore, the brushes are not preferable as the contact.

SUMMARY OF THE INVENTION

The present invention is made in view of the above disadvantages, and it is an object of the present invention to provide a magnet switch suppressing wear and sticking of contacts due to arc by proving a sub contact from a carbon material and by turning on and off an electric power supply in a condition that an electric current is substantially zero.

According to one aspect of the present invention, a magnet switch for a starter includes a first contact portion and a second contact portion, which operate electrical connection between a motor and a battery with a fixed contact and a movable contact. The first contact portion includes a carbon material. The first contact portion and the second contact portion are disposed such that the first contact portion makes contact before the second contact portion makes contact.

Because the second contact portion is not directly conducted, damage to the second contact portion, which has metal contacts, is suppressed. Since the first contact portion includes the carbon material that does not easily stick and has lubrication, even if arc occurs in the first contact portion due to thrash of the contact when the electric power is supplied to the motor, it is less likely that the contact will stick or abnormally wear.

According to a second aspect of the present invention, when the magnet switch is turned off, the first contact portion breaks contact after the second contact portion breaks contact. Since the electric current is not directly cut off in the second contact portion, it is less likely that arc will occur in the second contact portion, thereby suppressing damage to the contact. Since the first contact portion, the electric current to which is directly cut off, includes the carbon material having strength against the arc, it improves performance of the switch.

According to a third aspect of the present invention, a resistive component is included in a first circuit in series with the first contact portion. Because the electric current is restricted in the first circuit, load to the contact can be reduced. Further, the first contact portion and the second contact portion are connected in parallel. When the second contact portion makes contact, the electric power is not generally supplied to the first circuit including the resistive component, but supplied to the second circuit. Therefore, a necessary amount of the electric current is supplied to the motor.

According to a fourth aspect of the present invention, the carbon material is made of a hundred percents carbon or made of carbon with ten percents or less metal content. Thus, the carbon material provides a resistance (generally 50 milliohm). Because the resistive component is provided by the carbon material, the number of parts is reduced and structure becomes simple.

According to a fifth aspect of the present invention, a magnet switch includes an attraction coil generating an attraction force when excited, and a contact unit for electrically connecting a battery and a motor. The contact unit includes a first contact portion for auxiliary supplying electric power to the motor through a resistive component and a second contact portion for mainly supplying electric power to the motor. The resistive component is provided by a contact of the first contact portion made of a carbon material.

When the attraction coil is excited, a movable contact and a fixed contact of the first contact portion are brought into contact with each other while bending a return spring by the plunger and then a movable contact and a fixed contact are brought into contact with each other by further movement of the plunger. When the power supply to the motor is turned off, the movable contact and the fixed contact of the second contact portion are separated before the movable contact and the fixed contact of the first contact portion are separated, by the plunger moved with a return force of the return spring. Accordingly, on and off of the switch is controlled with a simple structure.

According to a sixth aspect of the present invention, the magnet switch further includes a resilient member for applying contact pressure to the first and the second contact portions. Therefore, it suppresses a voltage drop at the contact portions. Further, even if the contact is worn, the contact portion can make contact.

According to a seventh aspect of the present invention, the fixed contacts of the first and second contact portions are provided to be connected to the battery. Therefore, the contacts can be fixed to a starter body, thereby improving reliability. Further, the movable contacts and the resilient member, which are movable, are provided adjacent to the plunger. Therefore, this makes structure simple. For example, the movable contacts and the resilient member can be commonly used.

According to an eighth aspect of the present invention, a contact pressure to the first contact portion is gradually increased or decreased by a resiliency of a resilient portion in accordance with movement of the plunger. Therefore, the resistance of the contact provided by the carbon material is gradually changed from an infinite to a predetermined value (for example, 50 milliohm). In accordance with this, the electric current is gradually changed (for example, from 0 A to 100 A and 100 A to 0 A). Because the first contact makes contact and breaks contact in the condition that the electric current is zero, damage to the contact is decreased.

According to a ninth aspect of the present invention, the carbon material is formed into two layers. The first contact portion makes contact via the layer made of one hundred percents of carbon first, and breaks contact via the layer lastly. Therefore, it suppresses arc at the first contact portion and sticking of the contacts.

According to a tenth aspect of the present invention, the motor is rotated at full speed after a pinion is meshed with a ring gear at a low speed by the electric power reduced by the first contact portion. Therefore, damage to the ring gear decreases. Further, the first contact portion makes contact via the carbon material in a condition that the electric current is substantially zero. Therefore, a life of the switch increases.

BRIEF DESCRIPTION OF THE DRAWINGS

Other objects, features and advantages of the present invention will become more apparent from the following detailed description made with reference to the accompanying drawings, in which like parts are designated by like reference numbers and in which.

DETAILED DESCRIPTION OF EMBODIMENTS

Figure 1:
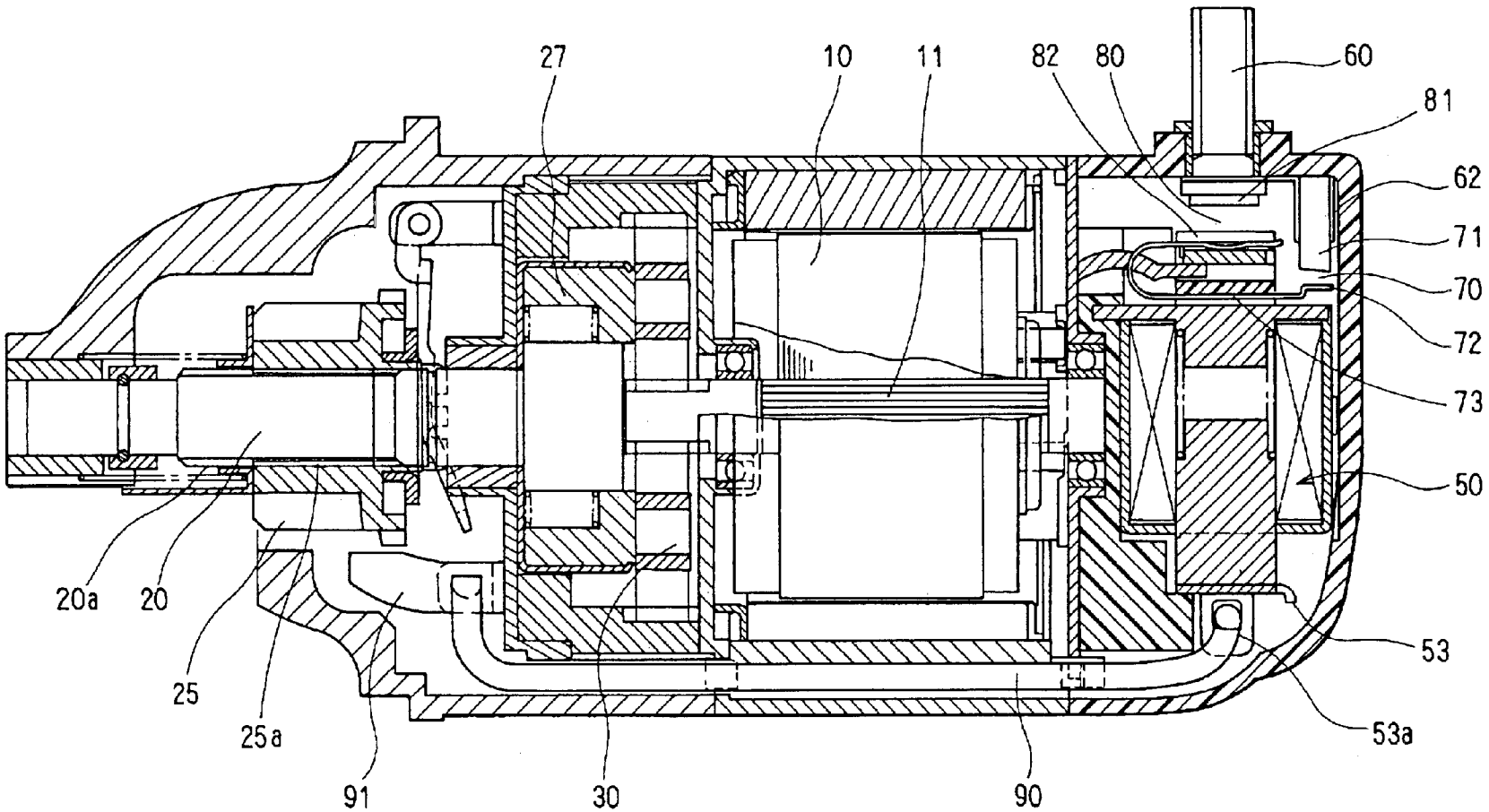
FIG. 1 is a cross-sectional view of a starter according to an embodiment of the present invention.

A starter of the present invention will be described based on an embodiment shown in FIGS. 1 through 4. Numeral 50 denotes a switch having an attraction coil 51 generating electromagnetic force, a plunger 52 included in a magnetic circuit, a case 55, a cover 54, and an air gap 56.

Numeral 70 denotes a first contact portion constructed of a fixed contact 71 and a movable contact 72. The fixed contact 71 is made of a carbon material that includes a hundred percents carbon or includes carbon mainly and a small amount of metal content. The movable contact 72 is a part of a first resilient member 73. The first resilient member 73 is made of a material having conductivity and mechanical strength, such as phosphor bronze.

Numeral 80 denotes a second contact portion constructed of a fixed contact 81 and a movable contact 82. The first contact portion 70 and the second contact portion 80 are connected in parallel between a battery and a motor. Since the first contact portion 70 includes the carbon material, it provides a resistance in the circuit. About 50 milliohm is required as a value of resistance in the circuit. The fixed contact 71 includes ten percents or less metal content to have a necessary resistance. As the carbon, graphite and amorphous carbon are used. Which one is used is decided in consideration of the metal content so that the first contact portion 70 provides the necessary value of resistance and has a long life.

The movable contacts 72, 82 apply contact pressure to the fixed contacts 71, 81 by resiliency of the first and second resilient members 73, 83. The resilient members 73, 83 are arranged to move with the plunger 52. Alternatively, the resilient members 73, 83 can be arranged adjacent to the fixed contacts 71, 81, respectively, or can be arranged to cross between the fixed contacts 71, 81, and the movable contacts 72, 82, respectively.

Figure 2:
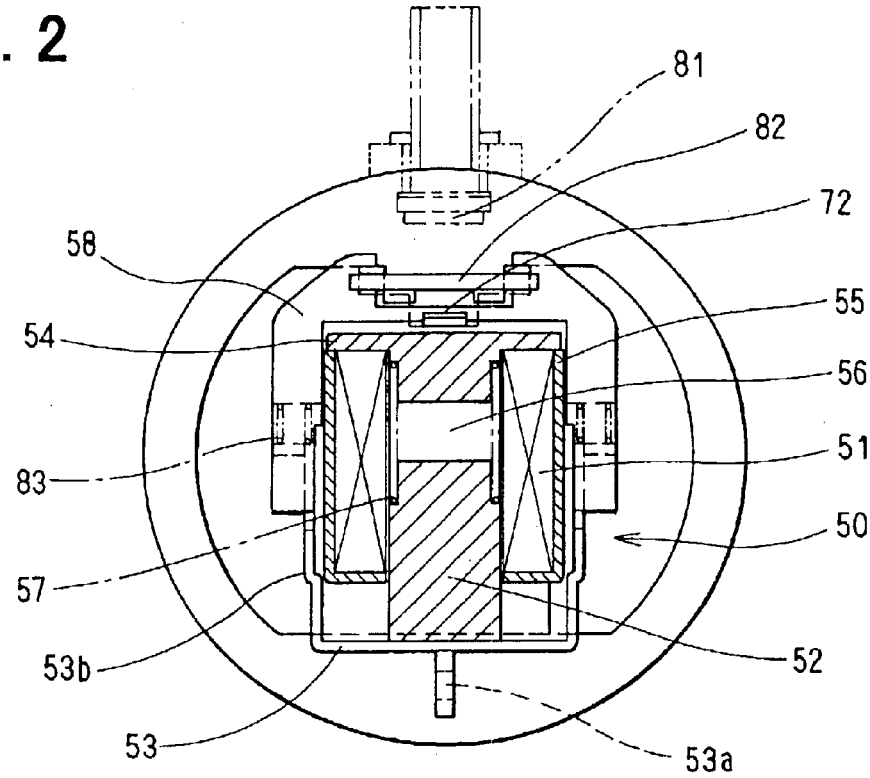
FIG. 2 is a cross-sectional view of a switch of the starter shown in FIG. 1.
Figure 3:
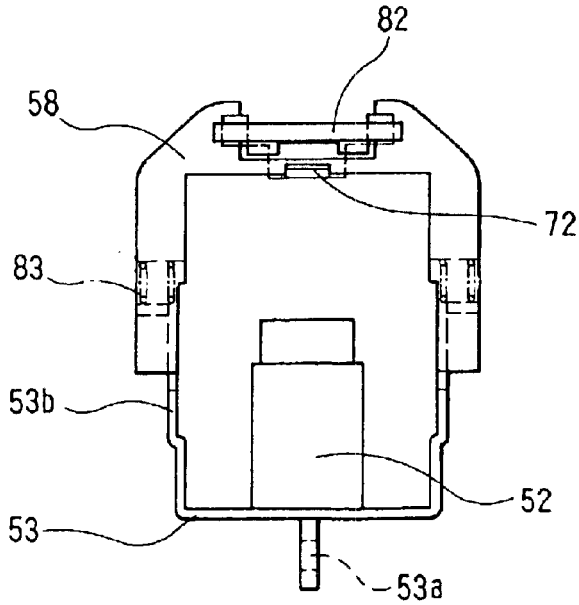
FIG. 3 is a schematic view of a movable portion of the switch shown in FIG. 1.
Figure 4:
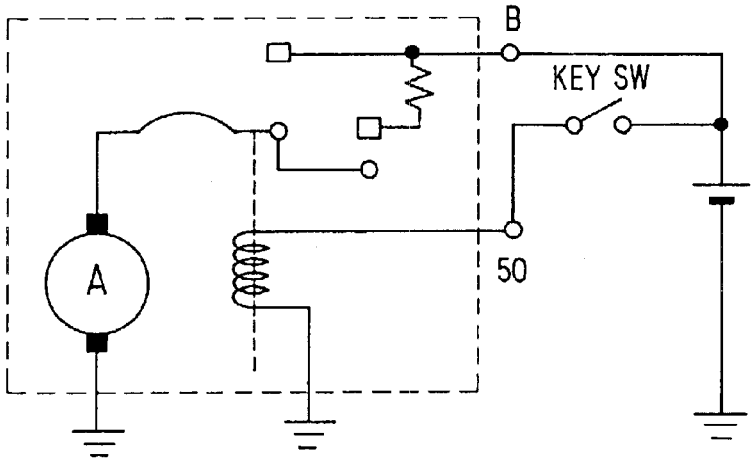
FIG. 4 is a circuit of the starter according to the embodiment of the present invention.

The fixed contact 71 of the first contact portion 70 is connected to a battery (not shown) through a holder 62. The fixed contact 81 of the second contact portion 80 is connected to the battery with a terminal 60. As shown in FIG. 2, a flange 53 and a joint portion 53*a* are fixed to an end of the plunger 52. A protruding end 53*b* of the flange 53 is connected to a holder 58 through the second resilient member 83. The movable contacts 72, 82 are fixed to an end of the holder 58 by means such as press-fitting. The flange 53, holder 58, and movable contacts 72, 82 are integrally movable in accordance with movement of the plunger 52, thereby working as a switch.

The joint portion 53*a* is formed with a hole into which an end of a connecting member 90 is inserted. The opposite end of the connecting member 90 restricts rotation of a pinion 25 through a member 91. Specifically, when the plunger 52 is attracted in a direction to close the air gap 56 by the attraction force of the attraction coil 51, the member 91 is brought into contact with the pinion 25 through the connecting member 90, thereby restricting rotation of the pinion 25. In this condition, when the motor begins rotation, the pinion 25 is moved in an axial direction through helical splines 20*a*, 25*a*, which are formed on the outer surface of an output shaft 20 and an inner surface of the pinion 25, and is brought into mesh with a ring gear (not shown) of an engine.

A shaft 11 of an armature 10 of the motor is coupled to the output shaft 20 through a speed reducing device 30 and a clutch 27. Numeral 57 denotes a return spring for returning the plunger 52 to a stationary position when the power supply to the attraction coil is cut off. In this embodiment, the return spring 57 is arranged in an inner periphery of the magnet switch 50 adjacent to the plunger 52. However, the return spring 57 can be arranged at another position as long as it can return the plunger 52 to the stationary position.

Next, operation of the present invention will be described. When a key switch (not shown) of a vehicle is turned on, the attraction coil 51 generates the electromagnetic force and the plunger 52 moves in the direction closing the air gap 56 against the return spring 57. The plunger 52 restricts rotation of the pinion 25 through the connecting member 90. Next, the first contact portion 70 is electrically connected through a resistive component, so the motor starts rotation very slowly. Here, the resistive component is provided by the carbon material included in the fixed contact 71.

With the rotation of the motor, the output shaft 20 rotates. The pinion 25 is pushed in an axial direction with an axial component of the helical splines 20*a*, 25*a* in a condition that its rotation is restricted, thereby meshing with the ring gear (not shown). When the plunger 52 is further moved, the second contact portion 80 is electrically conducted. Because the first contact portion 70 and the second contact portion 80 are connected in parallel and the resistive component is included in a circuit including the first contact portion 70, electric power from the battery is fully supplied to a circuit including the second contact portion 80. Therefore, the motor rotates at full speed, thereby starting the engine.

Once the engine starts and the key switch is turned off, the electromagnetic force of the attraction coil 51 disappears. The plunger 52 is returned by a spring force (return force) of the return spring 57, thereby opening the second contact portion 80. Thus, the power, which is reduced by the resistive component in the circuit of the first contact portion 70, is supplied to the motor. When the plunger 52 is further returned, the first contact portion 70 is open. The magnet switch of the present invention operates in this manner. Here, portions such as meshing portion, other than the switch, operate in a manner similar to a starter disclosed in JP-A-10-115274. Therefore, operation of those portions is not described here.

According to the present invention, a contact unit, which electrically connects the battery and the motor, includes two contact portions 70, 80. On and off of the power supply to the motor is performed by the first contact portion 70, and the electric current is always reduced by the resistive component in the circuit of the first contact portion 70. Further, the fixed contact 71 is made of the carbon material. Therefore, wear and sticking of the contact decreases.

Since the contact 71 can acts as a resistor, the number of parts is not increased. Further, even in a case that the power is continuously supplied to the magnet switch due to a defect of the key switch, it is less likely that the resistor will burn.

Figure 7:
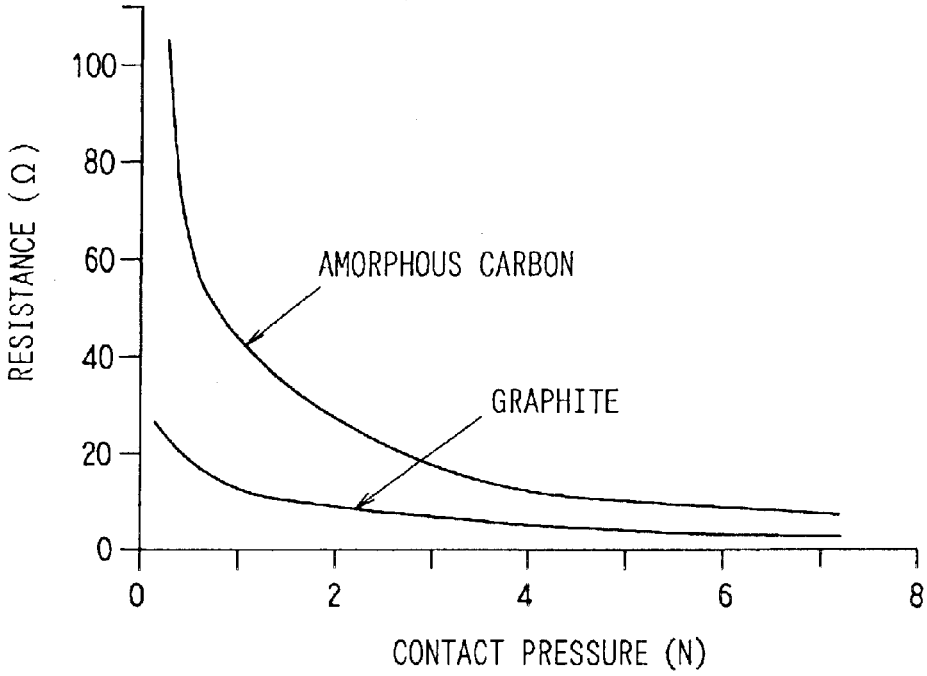
FIG. 7 is a graph explaining general relationship between contact pressure of carbon materials and electrical resistance.

The contact pressure to the fixed contact 71, which is made of the carbon material, is gradually increased and decreased by resiliency of the resilient member 73, in accordance with the movement of the plunger 52. As shown in FIG. 7, the contact resistance can be gradually decreased from a large value and gradually increased to the large value. Therefore, the first contact portion 70 can be closed and open in a condition that the electric current is substantially zero. Accordingly, wear and sticking due to arc is suppressed.

Further, the contact pressure required to the first contact portion 70 is very small, about 1N, and the contact pressure is applied gradually in a long stroke. Therefore, it does not effect to the attraction force of the switch 50. By using the carbon contact portion with the resilient member in addition to the main contact portion, an ideal switch can be provided.

Figure 6:
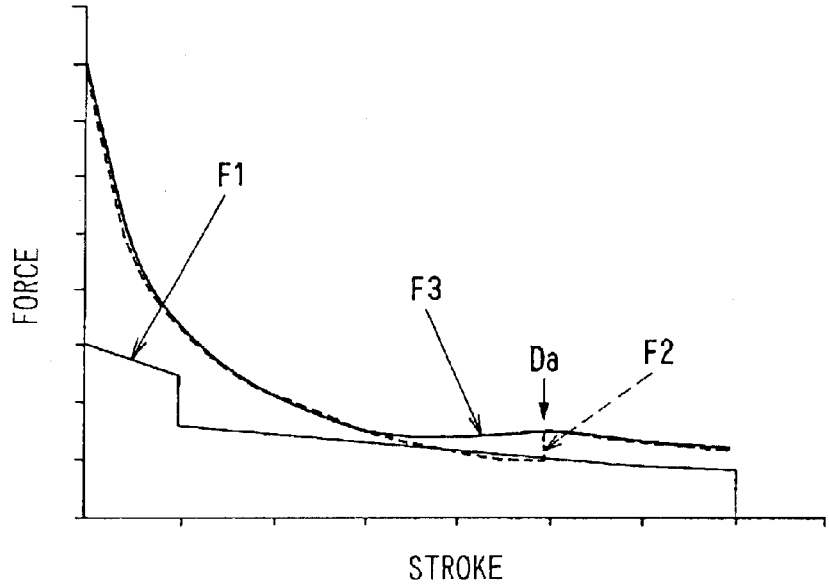
FIG. 6 is a graph explaining relationship between a force and a stroke of a switch and showing an advantage of the present invention.

Since the resistance gradually decreases and increases, it suppresses the voltage drop. Therefore, it is less likely that the attraction force will suddenly drop as in the case (F2) that the resistor having 50 milliohm is used, as shown in FIG. 6. Further, the attraction force F3 of the present embodiment does not decrease lower than the force F1 that is required to the switch operation. Also, the minimum operation voltage of the switch does not decrease. Although the fixed contact 71 is made of the carbon material, only one of or both of the fixed contact 71 and the movable contact 72 can be made of the carbon material.

Figure 5A:
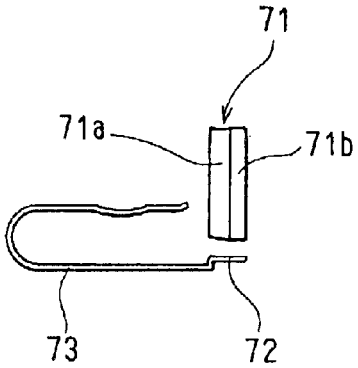
FIGS. 5A to 5C are schematic views of a first contact portion, each explaining a positional condition while the first contact portion making contact, according to another embodiment of the present invention.
Figure 5B:
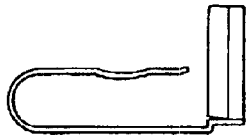
Figure 5C:
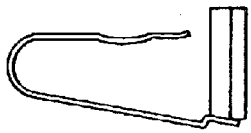

As a modified embodiment, the first fixed contact 71 can be formed into two layers, as shown in FIGS. 5A to 5C. Numeral 71*a* denotes a metal rich portion including much metal than carbon. Numeral 71*b* denotes a metal poor portion including less or no metal.

Operation of the fixed contact 71 will be described. When the switch is turned on, the movable contact 72 makes contact with the metal poor portion 71*b* first in accordance with movement of the plunger 52. Then, the movable contact 72 makes contact with the metal rich portion 71*a*. When the switch is turned off, the movable contact 72 separates from the metal rich portion 71*a* first, and then separates from the metal poor portion 71*b*.

Accordingly, on and off of the switch can be controlled more precisely by the double-layered fixed contact 71, as compared with the case that the first fixed contact 71 is entirely made of the carbon material. Thus, the above-described advantages can improve. Further, by combining this highly reliable, compact switch with the meshing in the pinion rotation restricted manner, the advantage further improves and reliability against meshing further increases. In this way, the present invention provides a long life, highly reliable, compact magnet switch.

The present invention should not be limited to the disclosed embodiments, but may be implemented in other ways without departing from the spirit of the invention.

What is claimed is:

1. A magnet switch for a starter to supply electric power to a motor, comprising:

a first contact portion having a fixed contact and a movable contact, the first contact portion including a carbon material;

a second contact portion having a fixed contact and a movable contact, the second contact portion including a metal material, wherein the first contact portion and the second contact portion operate an electrical connection between the motor and a battery, and wherein the first contact portion and the second contact portion are disposed such that the first contact portion makes contact before the second contact portion makes contact.

2. The magnet switch according to claim 1, wherein, the first contact portion and the second contact portion are disposed such that the first contact portion breaks contact after the second contact portion breaks contact.

3. The magnet switch according to claim 1, wherein the first contact portion includes a resistive component in series in a current path, wherein the first contact portion and the second contact portion are disposed to be in a parallel circuit between the battery and the motor.

4. The magnet switch according to claim 3, wherein the carbon material includes ten percent or less metal content and provides the resistive component.

5. The magnet switch according to claim 3, wherein the carbon material includes one hundred percent carbon and provides the resistive component.

6. The magnet switch according to claim 1, further comprising a resilient member for applying a contact pressure to the first and the second contact portions.

7. The magnet switch according to claim 1, wherein:

the carbon material includes two layers, the first layer includes more metal than carbon and the second layer includes one hundred percent carbon, and the first contact portion is disposed to make contact via the second layer before the first layer and to break contact via the first layer before the second layer.

8. A magnet switch for a starter, comprising:

an attraction coil for generating an attraction force when excited; and a contact unit for electrically connecting a battery and a motor, including:

a first contact portion for supplying electric power to a motor through a resistive component, the first contact portion including a movable contact and a fixed contact, one of the movable contact and the fixed contact being electrically connected to a battery and the other of the movable contact and the fixed contact being operatively coupled to a plunger that is movable by the attraction force; and a second contact portion for supplying electric power to the motor, the second contact portion including a movable contact comprised of a metal and a fixed contact comprised of a metal, one of the movable contact and the fixed contact being electrically connected to the battery and the other of the movable contact and the fixed contact being operatively coupled to the plunger, wherein the contact unit is disposed such that the movable contact and the fixed contact of the first contact portion are brought into contact with each other while bending a return spring by the plunger to supply the electric power to the motor through the resistive component before the movable contact and the fixed contact of the second contact portion are brought into contact with each other by further movement of the plunger to supply the electric power to the motor, and when the power supply to the attraction coil is turned off, the movable contact and the fixed contact of the second contact portion are separated before the movable contact and the fixed contact of the first contact portion are separated by a return force of the return spring, and wherein the resistive component is provided by a contact of the first contact portion, the contact being made of a carbon material.

9. The magnet switch according to claim 8, wherein the contact unit includes a resilient member for applying contact pressure to the first contact portion and the second contact portion.

10. The magnet switch according to claim 8, wherein the fixed contacts of the first and second contact portions are disposed to be connected to the battery, and the movable contacts of the first and second contact portions and the resilient member are disposed adjacent to the plunger.

11. The magnet switch according to claim 9, wherein the resilient member includes a resilient part for applying contact pressure to the contact made of the carbon material by its resiliency in accordance with the movement of the plunger, to gradually increase the contact pressure from zero to a predetermined pressure after the power supply to the attraction coil is started and gradually decreasing the contact pressure from the predetermined pressure to zero after the power supply to the attraction coil is cut off.

12. The magnet switch according to claim 8, wherein the carbon material includes two layers, the first layer is made of carbon and metal and the second layer is made of carbon, and wherein the first contact portion is disposed to make contact via the second layer before the first layer while the first contact portion is closed, and to break contact via the first layer before the second layer while the first contact portion opens.

13. The magnet switch according to claim 8, wherein:

the plunger is disposed to restrict rotation of a pinion, which is supported on an output shaft coupled to an armature shaft of the motor, through a connecting means while moved by the attraction force, the first contact portion has the contact made of carbon material that provides a resistance against the power supplied to the motor so that the pinion is pushed through helical splines formed the output shaft and brought into mesh with a ring gear of an engine, and the second contact portion allows the power to the motor so that rotation of the motor is transmitted to the output shaft through a speed reducing device, thereby starting the engine.

14. A magnet switch for a starter to supply electric power to a motor, the magnet switch comprising:

a first contact portion including a fixed contact and a movable contact for electrically connecting the motor and a battery, one of the fixed contact and the movable contact being made of a carbon material; and a second contact portion including a fixed contact comprised of a metal and a movable contact comprised of a metal, the second contact portion connected in parallel with the first contact portion between the battery and the motor, wherein the first contact portion is disposed to make contact before the second contact.

15. The magnet switch according to claim 14, wherein the carbon material includes ninety percent or more carbon, thereby providing a resistance in a circuit.

16. The magnet switch according to claim 14, further comprising:

an attraction coil for generating attraction force when excited; and a plunger movable by the attraction force, wherein the movable contacts of the first and the second contact portions are operatively coupled to the plunger, wherein the first contact portion makes contact before the second contact portion in accordance with movement of the plunger.

17. The magnet switch according to claim 16, further comprising:

a resilient member for applying contact pressure to the first contact portion in accordance with the movement of the plunger, wherein the resilient member gradually increases the contact pressure from zero to a predetermined pressure when the power supply to the attraction coil is started and gradually decreases the contact pressure to zero when the power supply to the attraction coil is cut off.

18. The magnet switch according to claim 14, wherein the fixed contact of the first contact portion is made of the carbon material, the carbon material is formed into two layers, and the first layer includes less carbon than the second layer, wherein the first contact portion is arranged such that the movable contact makes contact with the second layer before the first layer while the first contact portion is closed and the movable contact separates from the first layer before the second layer while the first contact portion opens.

19. The magnet switch according to claim 6, wherein the fixed contact of the first contact portion is made of the carbon material, and the resilient member has a first end and a second end, the moveable contact of the first contact portion is provided by the first end of the resilient member and the moveable contact of the second contact portion is disposed on the second end of the resilient member.

20. The magnet switch according to claim 9, wherein the resilient member has a U-shape having a first end and a second end and is moveable with the movement of the plunger, and the movable contact of the first contact portion is provided at the first end of the resilient member as a part of the resilient member and the moveable contact of the second contact portion is fixed to the second end of the resilient member.

21. The magnet switch according to claim 18, further comprising a resilient member having a first end and a second end, wherein the movable contact of the first contact portion is provided by the first end of the resilient member and the movable contact of the second contact portion is connected to the second end of the resilient member.

* * * * *